US008038016B2

(12) United States Patent
Yuyama et al.

(10) Patent No.: US 8,038,016 B2
(45) Date of Patent: Oct. 18, 2011

(54) INJECTION DRUG TAKEOUT DEVICE

(75) Inventors: Shoji Yuyama, Osaka (JP); Akira Taniguchi, Osaka (JP)

(73) Assignee: Yuyama Mfg. Co., Ltd., Toyonaka-shi (JP)

( * ) Notice: Subject to any disclaimer, the term of this patent is extended or adjusted under 35 U.S.C. 154(b) by 177 days.

(21) Appl. No.: 11/577,256

(22) PCT Filed: Oct. 12, 2005

(86) PCT No.: PCT/JP2005/018752

§ 371 (c)(1),
(2), (4) Date: Apr. 13, 2007

(87) PCT Pub. No.: WO2006/041072

PCT Pub. Date: Apr. 20, 2006

(65) Prior Publication Data

US 2007/0262084 A1 Nov. 15, 2007

(30) Foreign Application Priority Data

Oct. 15, 2004 (JP) ..... 2004-301713

(51) Int. Cl.
*A47F 1/04* (2006.01)
*A47F 7/00* (2006.01)
*B65H 1/08* (2006.01)

(52) U.S. Cl. ..... 211/59.3; 211/59.1; 211/59.2; 211/51; 211/175; 211/184; 211/221; 221/6; 221/227; 221/210; 221/153; 221/154; 221/9; 221/279; 221/226

(58) Field of Classification Search ..... 221/227, 221/135, 6, 210, 153, 154, 9, 226, 279, 131; 211/59.3, 59.1, 51, 175, 184, 59.2
See application file for complete search history.

(56) References Cited

U.S. PATENT DOCUMENTS

| | | | | | |
|---|---|---|---|---|---|
| 3,542,244 | A * | 11/1970 | Dyer et al. | ..... | 221/227 |
| 4,113,140 | A * | 9/1978 | Graef et al. | ..... | 221/6 |
| 4,200,201 | A * | 4/1980 | Collins et al. | ..... | 221/129 |
| 5,263,596 | A * | 11/1993 | Williams | ..... | 221/153 |
| 6,142,317 | A * | 11/2000 | Merl | ..... | 211/59.3 |
| 6,382,431 | B1 * | 5/2002 | Burke | ..... | 211/59.3 |
| 6,691,891 | B2 * | 2/2004 | Maldonado | ..... | 221/279 |
| 7,316,328 | B2 * | 1/2008 | Yuyama et al. | ..... | 221/227 |

(Continued)

FOREIGN PATENT DOCUMENTS

| | | | |
|---|---|---|---|
| JP | 2000 24087 | | 1/2000 |
| JP | 2000072204 | A * | 3/2000 |
| JP | 2000255717 | A * | 9/2000 |

(Continued)

*Primary Examiner* — Gene O. Crawford
*Assistant Examiner* — Rakesh Kumar
(74) *Attorney, Agent, or Firm* — Oblon, Spivak, McClelland, Maier & Neustadt, L.L.P.

(57) ABSTRACT

To reliably bias drugs to a rotor side without upsizing a device, with little layout limitations, and without damaging the drugs.

Biasing means that biases drugs stored in a cassette 3 to a rotor 23 side to arrange the drugs includes: a casing 35; a constant load spring 36 provided in the casing 35 and having a spring part 41 fixed to the rotor 23 side of the cassette 3 at its tip; a locking plate 42 provided in the casing 35 and having a gear part 46 that engaged with and disengaged from a locking rack 26 formed in the cassette 3; and a pressing block 43 projected so as to be pressed from the contact surface of the casing 35 in contact with the drugs and rotating the locking plate 42 by pressing to release the gear part 46 from the locking rack 26.

9 Claims, 17 Drawing Sheets

U.S. PATENT DOCUMENTS

| | | | | |
|---|---|---|---|---|
| 7,434,704 | B2 * | 10/2008 | Yuyama et al. | 221/222 |
| 7,506,769 | B2 * | 3/2009 | Howerton et al. | 211/59.3 |
| 7,520,247 | B2 * | 4/2009 | Rutledge | 119/51.01 |
| 2004/0140279 | A1 * | 7/2004 | Mueller et al. | 211/59.3 |
| 2006/0163272 | A1 * | 7/2006 | Gamble | 221/227 |

FOREIGN PATENT DOCUMENTS

| | | | | |
|---|---|---|---|---|
| JP | 2001 198194 | | | 7/2001 |
| JP | 2003 79701 | | | 3/2003 |
| JP | 2003079701 | A | * | 3/2003 |
| JP | 2005 330048 | | | 12/2005 |

* cited by examiner

INJECTION DRUG TAKEOUT DEVICE

TECHNICAL FIELD OF THE INVENTION

The present invention relates to a drug dispensing device capable of dispensing drugs stored in a drug shelf while checking them one by one.

BACKGROUND OF RELATED ARTS

Conventionally, disclosed as a drug dispensing device is the one having a large number of cassettes for arranging and storing drugs and support means for arraying and holding these cassettes. In the cassettes, a port opening is formed that permits pressing drugs as well as extracting them, and, to the cassettes, biasing means is attached which biases the stored drugs toward the port opening. The support means holds the cassettes with the port opening exposed (see, for example, patent document 1).

Patent Document 1: Japanese Unexamined Patent Publication No. 2001-198194

SUMMARY OF THE INVENTION

Problem to be Solved by the Invention

However, in the drug dispensing device described above, a weight is used as the biasing means for drugs. This requires arranging the cassettes in a tilted manner, thus raising problems of upsizing of the device and great limitations imposed on the layout and the like. Moreover, an increase in the number of drugs stored in the cassette results in an increase in the load acting on the drug located at the entrance, thus resulting in a risk of breakage and the like. Further, the drugs can be taken out freely, and this is not adoptable to the drugs, such as narcotic drugs and the like, that are strictly controlled.

Accordingly, it is an object of the present invention to provide a drug dispensing device capable of reliably biasing drugs to a rotor side without upsizing the device, with little layout limitations, and without damaging the drugs.

Means for Solving the Problems

To solve the problem described above, according to one aspect of the present invention, a drug dispensing device including cassettes detachably fitted to respective shelves of a storage shelf and storing different types of drugs, each of the cassettes having: a rotor that holds the drug at a closed position at one end side thereof and that rotates the drug to an open position to thereby permit the held drug to be taken out from outside; and biasing means that biases the stored drugs to the rotor side to thereby arrange the drugs in order. The biasing means includes: a casing; a constant load spring that is provided in the casing and that includes a spring part having a leading end thereof fixed to the rotor side of the cassette; a locking member that includes a locking part for engaging with and disengaging from a locking rack formed in the cassette, and a pressing member that projects in a pressable manner from an contact surface of the casing which contacts with the drug and that actuates the locking member by being pressed to thereby release the locking part from the locking rack.

With this structure, even when the cassette is arranged in the horizontal direction, the biasing means permits the stored drugs to be reliably held by the rotor. Since the biasing means includes a pressing member that projects in a pressing manner to an contact surface that contacts the drug stored in the cassette, as long as the contact surface is contacting the drug, the locking part of the locking member can be released from the locking rack, thus permitting a biasing force to reliably act on the drug.

The locking member may be formed of a locking plate that is so provided as to be rotatable about a support shaft and include a gear part in which the locking part engages with and disengages from the locking rack.

It is preferable to provide an operation button that projects in a pressing manner from a top surface of the casing and that releases the gear part from the locking rack by rotating the locking plate by a pressing operation via the pressing block.

The biasing means can change a quantity of constant load springs to be provided in accordance with a difference in a spring force.

It is preferable that the rotor include a circular arc part that, during rotation, guides the drug next to the drug held to thereby prevent a movement of the cassette in the longitudinal direction.

It is preferable that the rotor be formed of a front panel and a bottom plate in a substantially L shape, the bottom plate having a first guide part formed at one end part thereof and having a second guide part formed at a middle part thereof, and that the cassette include a support plate having: a first guide receiving part that reciprocatably guides the first guide part of the rotor in the direction orthogonal to the longitudinal direction of the cassette, and a second guide receiving part that reciprocatably guides the second guide part in the longitudinal direction of the cassette.

With the rotor structured as described above, upon dispensing the drug, the next drug can be prevented from moving in the longitudinal direction of the cassette, thereby preventing occurrence of problems such as jamming.

It is preferable that each shelf of the storage shelf includes the lock member that engages with a lock receiving part of the cassette to thereby prevent detachment, that a driving force of a motor be transmitted to the rotor via a gear, and that the gear include a lock release part that drives the lock member to drop the lock member from the lock receiving part of the cassette, because this permits managing taking-out of the cassette.

It is preferable that each shelf of the storage shelf have a key hole through which a key is inserted to thereby drive the lock member cassette, whereby the lock member can be dropped from the lock receiving part of the cassette, because this permits flexibly supporting even a case where manual dispensing is performed.

EFFECTS OF THE INVENTION

According to the present invention, a pressing block is provided which projects from the contact surface of the casing that contacts the drug. Thus, as long as the contact surface contacts the drug, the gear part of the locking plate can be released from the locking rack, thus permitting a biasing force to reliably act on the drug. Thus, even when the cassette is placed in the horizontal direction, the drugs in the cassette become continuous, so that the drugs can be reliably taken out by rotating the rotor. Moreover, the biasing force that acts is provided by the constant load spring; therefore, problems such as damage to the drugs do not occur.

PREFERRED EMBODIMENTS OF THE INVENTION

Hereinafter, embodiments according to the present invention will be described, referring to the accompanying drawings.

FIG. 1 shows a drug dispensing device according to the present embodiment. In this drug dispensing device, a plurality of shelf members 2 are disposed in a storage shelf 1 in a matrix form, and to each of the shelf members 2, a cassette 3 is detachably fitted. On the front surface of the storage shelf 1, an operation display panel 4 is provided which permits predetermined inputs and displays.

The shelf member 2 is inserted from the front of the storage shelf 1, and is fixed inside the storage shelf 1 with shelf fixing metal fittings 5 provided at four sections on both sides, as shown in FIG. 2. During maintenance and the like, by releasing the state of the shelf member 2 being fixed with the shelf fixing metal fitting 5, the shelf member 2 can be detached from the storage shelf 1.

On the front end side of the shelf member 2, a motor 7 is provided. The driving force of the motor 7 is transmitted to a rotor gear 10, via an intermediate gear 9, from a drive gear 8 fixed to a rotational axis 7*a* of the motor 7. As shown in FIG. 3, a lock release cam 11 is integrated with the drive gear 8. The leading end of the lock release cam 11 contacts one end part of a cassette lock lever 12. The cassette lock lever 12 is so provided as to be rotatable about a support shaft 12*a*. At one end part of the cassette lock lever 12, a lock part 14 is formed which engages with and disengages from a lock hole 13 of the cassette 3. The cassette lock lever 12 is biased in the rotation direction by a spring 12*b* provided to the support shaft 12*a* so that the lock part 14 engages with the lock hole 13 (see FIG. 4). At the central part of the rotor gear 10, an engagement receiving part 15 is formed which projects inward. The engagement receiving part 15 is formed in the shape of a groove with which an engaging projection 32 projecting from a rotor 23 of the cassette 3 to be described later can engage. Then driving the motor 7 to reversely rotate with the engaging projection 32 engaged with the engagement receiving part 15 can cause the rotor 23 to reversely rotate. As shown in FIG. 5, to the rotational axis of the motor 7, three detection plates 16 are provided and are respectively detected by slit sensors 17. The detection plates 16 are formed with notch parts 16*a* located at mutually different positions in the rotation direction as shown in FIG. 3. Detection of the respective notch parts 16*a* by the slit sensors 17 permits detection of a closed position, an open position, and a lock release position of the rotor 23 respectively. Near the rotor gear 10, a drug detection sensor 18 is provided which detects whether or not the drug D (here, a box storing a drug) is held by the rotor 23.

To the bottom wall of the shelf member 2, as shown in FIG. 2, a plurality of lead switches 19 are provided in the front half part and the rear half part in two rows in the width direction. Each lead switch 19 turns into an ON state when a magnet 38 provided on a casing 35 to be described later approaches the lead switch 19. Therefore, by detecting this ON state, the position of the casing 35, that is, a forcing unit 24 is identified and the remaining amount of drugs inside the cassette 3 is calculated. The lead switches 19 in the rows are respectively mounted on counting boards 20 with the central parts thereof so arranged as to longitudinally overlap with each other. The overlapping area is provided so as to use the same counting board 20 for cassettes 3 of different lengths. In this embodiment, the counting boards 20 are arranged in two rows, but may be provided in one row or 3 or more rows. That is, it is advised that the counting boards 20 of the same size be shared by cassettes 3 of different sizes.

On the back end side of the shelf member 2, a projecting piece 21 is provided which is biased to the front end side by a spring 21*a*. When the cassette 3 is fitted to the shelf member 2, the projecting piece 21 is pressed to the back end surface of the cassette 3 so as to be detected by a limit switch 22. This permits detection of the state of attachment and detachment of the cassette 3 to and from the shelf member 2.

The cassette 3 is, as shown in FIGS. 6 through 8, formed in the box-like shape whose upper and front sides open and has a rotor 23 provided at the front opening end part thereof, thus permitting dispensing the drugs D one by one. The drugs D inside the cassette 3 are stored in an arranged manner and forced forward by the forcing unit 24.

Near the front opening end of the cassette 3, a guide plate 25 is provided, in the upper part, which guides the top surface of the drug D adjacent to the drug D held by the rotor 23. This prevents dislocation of the next drug D in the vertical direction upon rotation of the rotor 23.

At the central part of the bottom wall of the cassette 3, a locking rack 26 is formed in the longitudinal direction. The locking rack 26 is composed of a plurality of horizontally long depressions 26*a* that are provided longitudinally at a predetermined pitch. At the both sides of the locking racks 26, guide grooves 27 are formed, at the sides of which guide rails 28 are formed. On one of the guide grooves 27, a spring part 41 of a constant load spring 36 is arranged. The other guide groove 27 is used for arranging an additional spring part 41 of the constant load spring 36 when a sufficient spring force cannot be provided with only one spring part 41.

The rotor 23 is, as shown in FIG. 7, composed of a rotary member 29, and a front panel 30 fitted to this rotary member 29.

The rotary member 29 includes a circular arc part 31 that bulges downward at the closed position. The circular arc part 31 contacts the drug D arranged adjacent to the drug D held by the rotor 23 upon rotation of the rotor 23, which prevents its dislocation in the longitudinal direction. On the central part of the rotary member 29, the engaging projection 32 is formed which engages with the engagement receiving part 15 of the rotor gear 10 described above. With the cassette 3 fitted to the shelf member 2, the engaging projection 32 engages with the engagement receiving part 15, whereby the driving force of the motor 7 can be transmitted to the rotary member 29.

The front panel 30 is screwed to the rotary member 29 via a spacer 33. In the rotary member 29, through-holes 30*a* are formed which are partially continuous, and, by selecting and screwing the through-hole 30*a* to be used, the fitting position of the front panel 30 can be adjusted in accordance with the size of the drug D. To the front panel 30, a seal 34 is attached on which the name of the drug D, a bar code for identifying the drug D to be stored, and the like are printed.

The forcing unit 24 stores: in the casing 35, the constant load spring 36, a locking member 37, and magnets 38, as shown in FIG. 8 through FIG. 11, more specifically in FIG. 11. One end surface of the casing 35 is configured to contact the drug D stored in the cassette 3. On the both bottom side parts of the casing 35, guides 39 are formed in a hook shape downward, and slidably guides the forcing unit 24 to the cassette 3 by being locked into the guide rail 28 formed on the bottom surface of the cassette 3.

The constant load spring 36 is formed of a drum 40 and the spring part 41 having a long band plate wound around the drum 40, and restores its original state with a fixed force when the leading end of the spring part 41 is drawn out, and thus a commercially available Conston (Registered trademark) or the like is used. The spring part 41 of the constant load spring 36 is drawn out from the casing 35 and is disposed on the guide groove 27 formed on the bottom surface of the cassette 3, with the leading end part thereof fixed to the front end side of the cassette 3.

Note that two or more constant load springs 36 may be provided as appropriate, that is, in accordance with a biasing force required for pressing the drug D. In this embodiment, the guide grooves 27 are formed in two rows on the bottom surface of the cassette 3 so as to support both cases where one constant load spring 36 is provided and where two constant load springs 36 are provided.

The locking member 37 includes a locking plate 42, a pressing block 43, and an operation button 44.

The locking plate 42 is so provided as to be rotatable about a support shaft 42*a*, has an operation receiving part 45 formed on one end thereof and has a gear part 46 formed on the other end thereof. The operation receiving part 45 can be pressed by one end of a press part while the gear part 46 can be engaged and disengaged with the depressions 26*a* of the locking rack 26. The locking plate 42 has the gear part 46 heavier with respect to the support shaft 42*a*, and this gear part 46 engages with the locking rack 26 under its own weight (it may also be biased in the engagement direction by biasing means such as a spring or the like). This can prevent occurrence of a problem that the forcing unit 24 suddenly moves to hit the stored drugs D even when the gear part 46 is released from the locking rack 26 after filling the drugs D into the cassette 3.

The pressing block 43 has one end surface 43*a* projecting in a pressable manner from an opening formed in an contact surface 35*a* (one end surface contacting the drug D) of the casing 35 and has another end surface 43*b* contacting the operation receiving part 45 of the locking plate 42. In the central part of the pressing block 43, a guide hole 49 is formed, so that the operation button 44 is stored liftably. Of inner side surfaces forming the guide hole 49, the surface located on the pressing surface side is gradually tilted upward to the surface 43*b* side, serving as a tilted surface 49*a*.

The operation button 44 is liftably stored in the guide hole 49 of the pressing block 43 described above and is biased upward by a spring 44*a*. On the operation button 44, a pressing surface 44*b* is formed for causing the pressing block 43 to make sliding movement while contacting the tilted surface 49*a* of the guide hole 49.

The magnets 38 are provided at two sections in correspondence with the lead switches 19 arranged in two rows in the shelf member 2 described above. By detecting the magnet 38 by the lead switch 19, the position of the forcing unit 24 is calculated, and the quantity of the drugs D stored in the cassette 3 is counted.

The cassette 3 can be detached from the shelf member 2 by a dedicated key 50. More specifically, when manual take-out is required instead of automatic opening by driving the motor 7, the cassette 3 can be pulled out by inserting the dedicated key 50 in a key hole of the shelf member 2.

The dedicated key 50 has the leading end thereof divided into two whose projecting dimensions are different from each other. When the dedicated key 50 is inserted in the key hole, a long piece 50*a* first presses a first tilted surface 12*c* of the cassette lock lever 12, whereby the cassette lock lever 12 slightly rotates against a biasing force of the spring 12*b* clockwise as viewed in the figure. Then, when the dedicated key 50 is further inserted, a short piece 50*b* now presses an upper second tilted surface 12*d* of the cassette lock lever 12. The cassette lock lever 12 with the upper tilted surface 12*d* pressed further continues its rotation to release the lock part 14 from the lock hole 13 of the cassette 3, whereby the cassette 3 can be taken out from the shelf member 2. When only a plate member is inserted instead of the dedicated key 50, a plate material contacts a lower second tilted surface 12*e* and biases the cassette lock lever 12 about the support shaft 12*a* counterclockwise as viewed in the figure. Thus, the lock part 14 is kept located in the lock hole 13, which makes it impossible to detach the cassette 3.

Next, an operation performed by the drug dispensing device structured as described above will be described.

Based on prescription data (in this embodiment, drug information indicated on prescription), the motor 7 is driven at the cassette 3 where corresponding drugs D are stored, whereby the rotor 23 rotates via the drive gear 8, the intermediate gear 9, and the rotor gear 10. In the rotor 23, of the drugs D forced and arranged by the forcing unit 24, only the one at the top is held. Therefore, the rotation of the rotor causes only the drug D at the top to move to the open position, that is, the position that permits this drug to be taken out from the front of the storage shelf 1. At this point, the circular arc part 31 formed at the rotary member 29 of the rotor 23 contacts the front surface of the next drug D and thus the next drug D never moves in the anteroposterior direction of the cassette 3. Moreover, the top surface of the next drug D is guided by the guide plate 25 and thus the next drug D never becomes dislocated vertically. Therefore, even if the drug D at the top is moved to the open position, the next drug D is kept at a stable position, thus having no adverse effect on the third and subsequent drugs D.

Based on a detection signal at the slit sensor 17, the rotor 23 is stopped at the open position. Then, when the drug D is taken out from the rotor 23, the motor 7 is reversely driven based on a detection signal at the drug detection sensor 18, whereby the rotor 23 is restored to the closed position. As a result, the drug D at the top of the drug row (the next drug described above) biased by the forcing unit 24 is held by the rotor 23.

Hereinafter, drug dispensing processing is continued in the same manner, and the remaining amount of drugs in each cassette 3 is detected by the lead switch 19 in the following manner.

More specifically, as shown in FIG. 13, there are provided: a resistance circuit in which, of a large number of resistors Rl to Rn (10Ω) serially connected, the resistor Rl at one end is connected to a Vcc terminal having a power supply with a constant voltage of 5V while the resistor Rn at the other end is grounded; and a detection circuit in which one end of each of the lead switches 19 of RSl to RSn is connected between the adjacent resistors Rl to Rn while the other end of each of the lead switches 19 of the RSl to RSn is connected to a detection terminal of a controller 51. In this measuring device, even if the lead switch 19 of RSl is turned on, partial pressure at the midpoint between R1 and R2 is inputted into the controller 51. Thus, a different voltage of 5V or below is detected depending on the position of the lead switch 19 turned on.

In FIG. 14, the detection circuit of the device of FIG. 13 is arranged in parallel in a plural number. The first circuit is composed of lead switches 19 of RSl, RS4, RS7, RS10, RS13, . . . ; the second circuit is composed of lead switches 19 of RS2, RS5, RS8, RS11, RS14, . . . ; the third circuit is composed of lead switches 19 of RS3, RS6, RS9, RS12, RS15, . . . . Between the lead switches 19 of each circuit and the detection terminal, resistors R22, R23, and R24 (100 Ω) are connected respectively. The lead switches 19 are, as shown in FIG. 16, arranged in line at intervals of 5 mm. As shown in FIGS. 17 and 18, when the magnet 38 approaches one lead switch 19, this lead switch 19 and the adjacent lead switches 19 on the both sides thereof are also turned on. As shown in FIGS. 19 and 20, when the magnet 38 approaches between the two lead switches 19, these two lead switches 19 are turned on. Therefore, two or more of the lead switches 19 provided on the three respective circuits are not turned on at the same time.

Assume that RS9 of the first circuit, RS10 of the second circuit, and RS11 of the third circuit are on, voltages V9, V10, and V11 applied to RS9, RS10, and RS11 are respectively as shown below.

$$V_9 = [(R10 + \cdots + R21)]/(R1 + \cdots + R21)] \times 5(V) = 120/210 \times 5\,(V) \quad \text{[Equation 1]}$$

$$V_{10} = [(R11 + \cdots + R21)]/(R1 + \cdots + R21)] \times 5(V) = 110/210 \times 5\,(V) \quad \text{[Equation 2]}$$

$$V_{11} = [(R12 + \cdots + R21)]/(R1 + \cdots + R21)] \times 5(V) = 100/210 \times 5\,(V) \quad \text{[Equation 3]}$$

These voltages V9, V10, and V11 are averaged while passing through a resistance of 100 Ω and then inputted to the controller 51.

When the RS10 of the first circuit and the RS11 of the second circuit are on, the voltages V10 and V11 applied to the RS10 and the RS11 are respectively as shown below.

$$V_{10} = [(R11 + \cdots + R21)]/(R1 + \cdots + R21)] \times 5(V) = 110/210 \times 5\,(V) \quad \text{[Equation 4]}$$

$$V_{11} = [(R12 + \cdots + R21)]/(R1 + \cdots + R21)] \times 5(V) = 100/210 \times 5\,(V) \quad \text{[Equation 5]}$$

These voltages V10 and V11 are averaged while passing through a resistance of 100 Ω and then inputted to the controller 51.

In the measuring device of FIG. 13, if the magnet 38 is located between the lead switches 19 of the R2 and the R3 and if the two lead switches 19 of the RS2 and the RS3 are turned on, a current flows mainly to the lead switch 19 of the RS2 located upstream, thus resulting in a possibility that the magnet 38 is detected as if it were located near the lead switch 19 of the R2. Thus, in the measuring device of FIG. 13, when an arrangement pitch of the lead switches 19 is 5 mm, a resolution is also 5 mm. On the contrary, in the measuring device of FIG. 14, when the magnet 38 is located between the two lead switches 19 and when the two lead switches 19 are both turned on, the averaged voltage is detected. Therefore, when the arrangement pitch of the lead switches 19 is 5 mm, a resolution of 2.5 mm is obtained which is half the arrangement pitch thereof.

In the measuring device of FIG. 13, if the magnet 38 is located near the lead switch 19 of the R3 and if the three lead switches 19 of the RS2, the RS3, and the RS4 are turned on, a current mainly flows to the lead switch 19 of the RS2 located upstream, thus resulting in a possibility that it is detected as if the magnet 38 were located near the lead switch 19 of not the R3 but the R2. On the contrary, in the measuring device of FIG. 14, even if the three lead switches 19 of the RS2, the RS3, and the RS4 are turned on, their detection circuits are separately provided and thus a current flows to any of the lead switches 19, thus permitting accurate detection.

The measuring device of FIG. 15 is the one obtained by removing the even-numbered lead switches 19 of the measuring device of FIG. 14. In this case, the arrangement pitch of the lead switches 19 becomes 10 mm, and the resolution decreases to 5 mm, but the number of the lead switches 19 reduces by half, thus permitting cost reduction.

If the drug detection sensor 18 does not detect the next drug D, the pharmacist is informed of the shortage by a buzzer or the like. Moreover, based on the residual amount of the drugs detected by the lead switch 19, when the residual amount decreases lower than a previously set value, the pharmacist may be informed by a buzzer or the like that urges him or her for filling.

When shortage or the like of the drugs D occurs, an operation of filling the drugs D is performed in the following manner.

More specifically, first, from the shelf members 2 of the drug shelf, the cassette 3 for which filling of the drugs D is required is taken out. To take out the cassette 3, the motor 7 is reversely driven, and the rotor 23 is rotated to the lock release position, whereby the locking by the cassette lock lever 12 is released, thereby permitting the cassette 3 to be taken out from the shelf member 2.

In the cassette 3, the forcing member 24 moves to the rotor side under the action of the constant load spring 36. Then the locking plate 42 is rotated by pressing the pressing block 43 or the operation button 44 to release the gear part 46 of the locking plate 42 from the engaging rack 26. Then, while continuing the pressing operation, the forcing unit 24 is so slid to move to the rear end side of the cassette 3 to thereby release the pressing operation. This causes the locking plate 42 to rotate about the support shaft under its own weight to thereby lock the gear part 46 into each depression of the locking rack 26, whereby the movement of the pressing unit is prevented.

Under this condition, the drugs D are stored into the cassette 3. Then, the gear part 46 of the locking plate 42 is released from the locking rack 26 by dislocating the stored drugs D to press the pressing block 43 or by pressing the operation button 44 with fingers. The casing 35 presses the drugs D stored in the cassette by the spring force of the constant load spring 36 and arranges them with the drug D held by the rotor 23 serving as a drug D at the top. During the movement of the forcing unit 24, a contact surface 35*a* of the casing 35 presses the drugs D while contacting the drugs D, whereby the pressing block 43 is constantly pressed, thereby permitting the stored drugs D to be reliably arranged.

FIG. 12 shows a rotor 52 according to another embodiment. This rotor 52 is formed by bending a flat plate into a substantially L shape and is composed of a front panel 53 and a bottom plate 54. These members are supported by a support plate 55 fixed to the cassette 3. To the front panel 53, a seal, not shown, is attached on which the name of the drug D, a bar code for identifying the drug D to be stored, and the like are printed as described above. The bottom plate 54 has a first projection 54*a* as a first guide part formed at one end both side parts thereof and a second projection 54*b* as a second guide part formed at the middle both side parts thereof. In the support plate 55, there are formed: a first slotted hole 55*a* as a first guided part that reciprocatably guides the first projection 54*a* of the rotor 52 in the direction orthogonal to the longitudinal direction of the cassette 3, i.e., in the vertical direction; and a second slotted hole 55*b* as a second guide receiving part that reciprocatably guides the second projection 54*b* in the longitudinal direction of the cassette 3, i.e., in the horizontal direction.

With this structure, the rotation of the rotor 52 causes the second projection 54*b* to move along the second slotted hole 55*b*, so that one end part of the bottom plate 54, that is, a part that supports the drug D next to the drug D held by the rotor 52, is forced to move vertically. That is, the position for supporting the next drug D in the horizontal direction does not change. Therefore, despite simple and low-cost structure, the next drug D can be adequately supported without being dislocated in the horizontal direction.

FIG. 21 shows a forcing unit 56 according to another embodiment. This forcing unit 56 is structured so that a first release arm 57 and a second release arm 58 move a locking arm 59 up and down to thereby engage and disengage it with the locking rack 26. These arms 57, 58 and 59 are each bar-shaped, with one end side thereof formed with gear parts 57*a*, 58*a*, and 59*a*, respectively. The gear part 57*a* of the first release arm 57 interlocks with a first interlocking gear 60*a*, and the gear part 58*a* of the second release arm 58 and the gear part 59*a* of the locking arm 59 interlock with a second interlocking gear 60*b*. The first release arm 57 corresponds to the pressing block 43 described above, and is biased by a spring 61 and has a pressing projection 57*b* projecting in a pressable manner from the contact surface 35*a* of the casing 35. The second release arm 58 corresponds to the operation button 44 described above, and has a pressing projection 58*b* projecting in a pressable manner from the top surface of the casing 35. The locking arm 59 corresponds to the locking plate 42 described above, and has a lower end locking part 59*b* appearing from the bottom surface of the casing 35 so as to be engageable with and disengageable from the locking rack 26.

In the pressing unit 56 structured as described above, the pressing projection 57*b* of the first release arm 57 is biased by a biasing force of the spring 61 in such a manner as to project from the casing 35. Thus, the pressing projection 58*b* of the second release arm 58 projects from the top surface of the casing 35 via the first interlocking gear 60*a*. The lower end locking part 59*b* of the locking arm 59 projects from the bottom surface of the casing 35 to lock into the locking rack 26, whereby the pressing unit 56 is positioned. In this condition, by making the drug D contact the contact surface 35*a* of the casing 35 to press the pressing projection 57*b* of the first release arm 57 in the casing 35 or by pressing the pressing projection 58*b* of the second release arm 58 with fingers to rotate the interlocking gears 60*a* and 60*b* against the biasing force of the spring 61, the locking arm 59 moves up, whereby the locking between the lower end locking part 59*b* and the locking rack 26 is released. As a result, the forcing unit 56 becomes movable, thereby permitting the drugs D in the cassette 3 to be pressed and arranged.

Alternatively, the second release arm 58 described above may be structured so that the pressing projection 58*b* projects in a pressable manner from the back surface, the side surface, and the like of the casing 35 as appropriate.

BRIEF DESCRIPTION OF THE DRAWINGS

FIG. 6A is a side view of a cassette.

Figure 1:
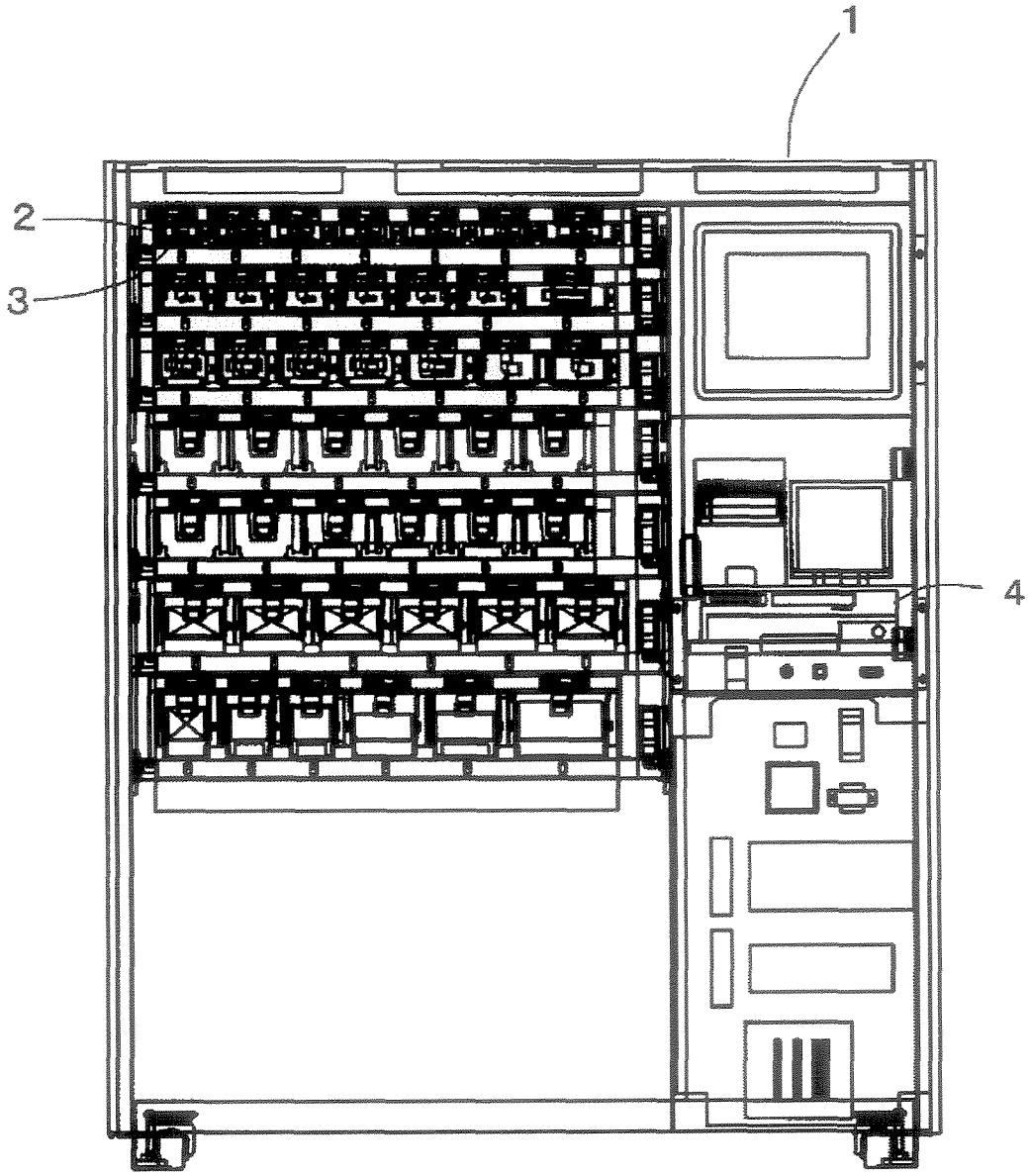
FIG. 1 is an elevation view of a drug dispensing device according to the present embodiment.
Figure 2:
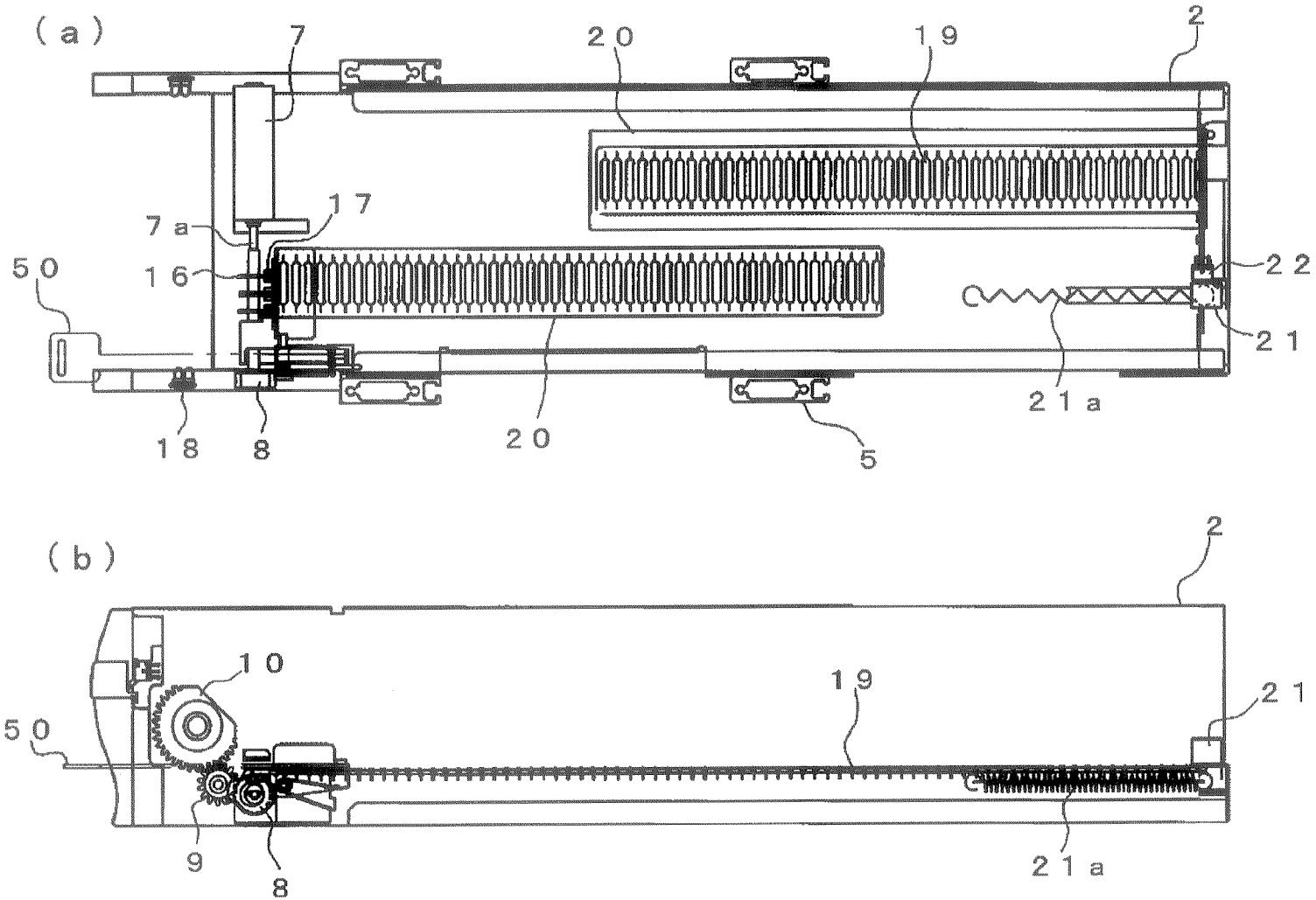
FIG. 2A is a plan view of a shelf member of FIG. 1.
FIG. 2B is a side view thereof.
Figure 3:
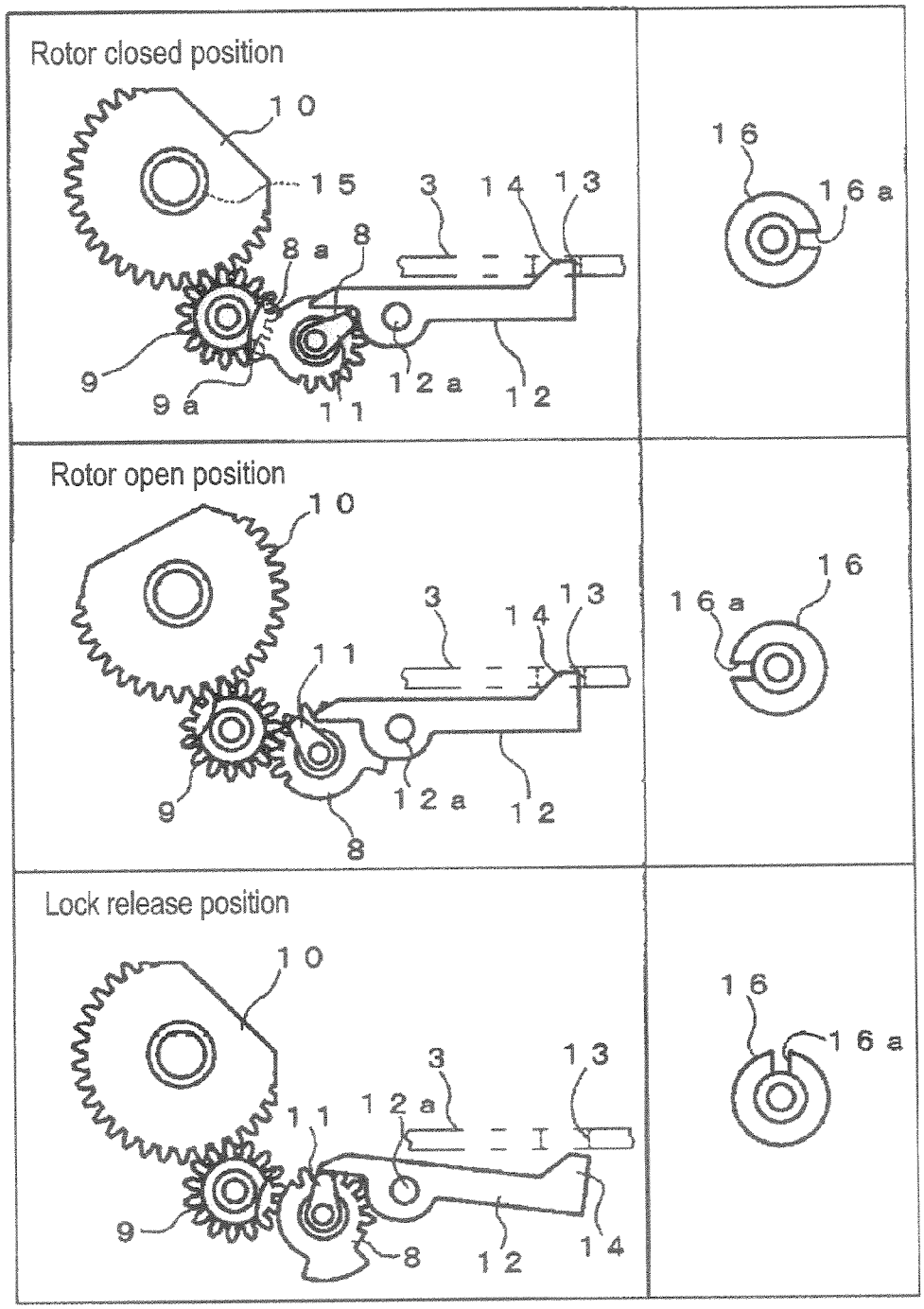
FIG. 3 is an explanatory diagram showing operations performed by gears and the like for driving a rotor.
Figure 4:
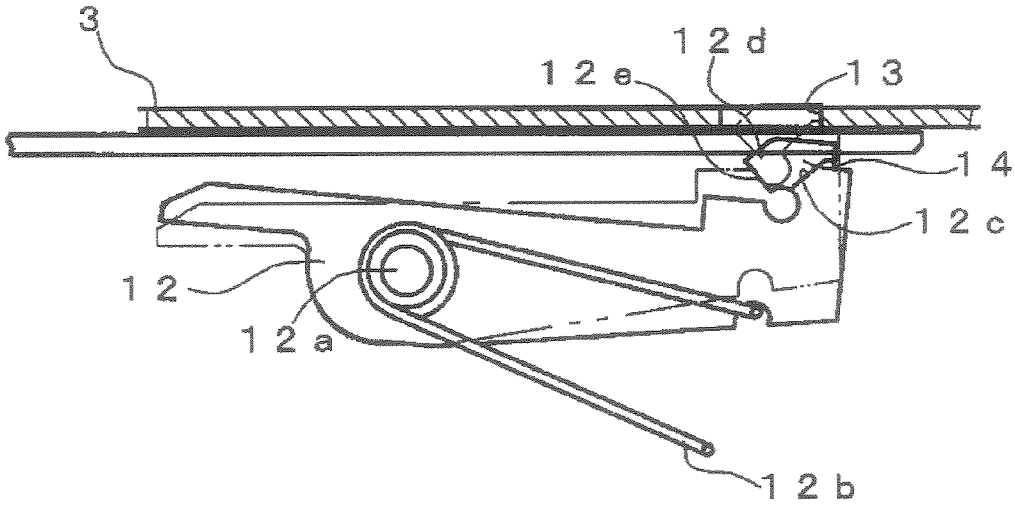
FIG. 4 is an explanatory diagram showing an operating state of a cassette lock lever of FIG. 3.
Figure 5:
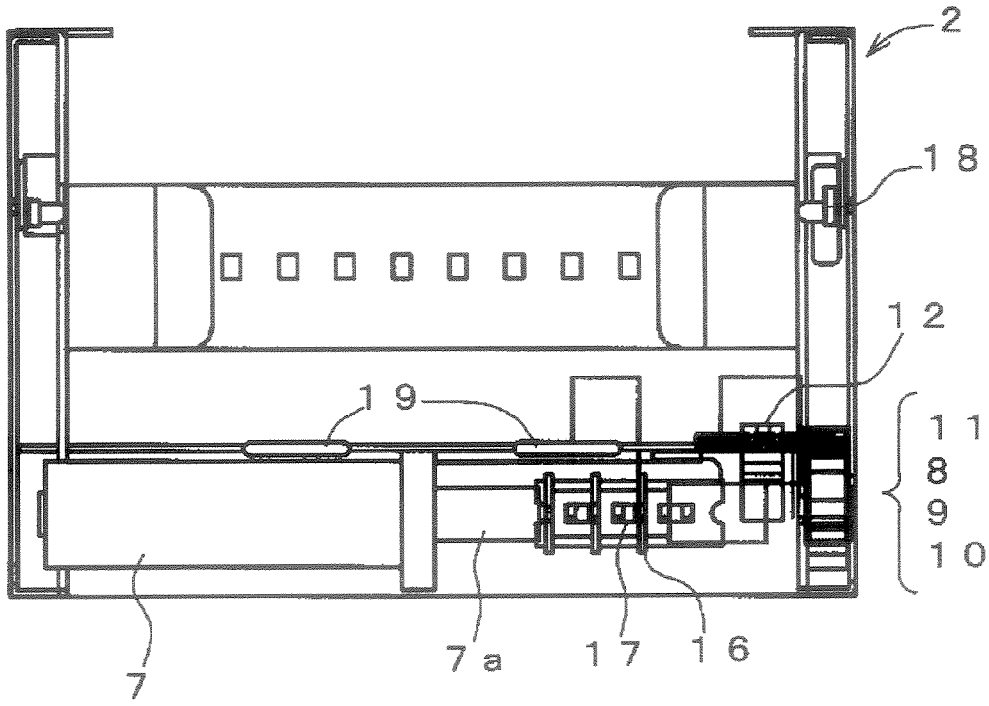
FIG. 5 is an elevation view of a shelf member shown in FIG. 1.
Figure 6:
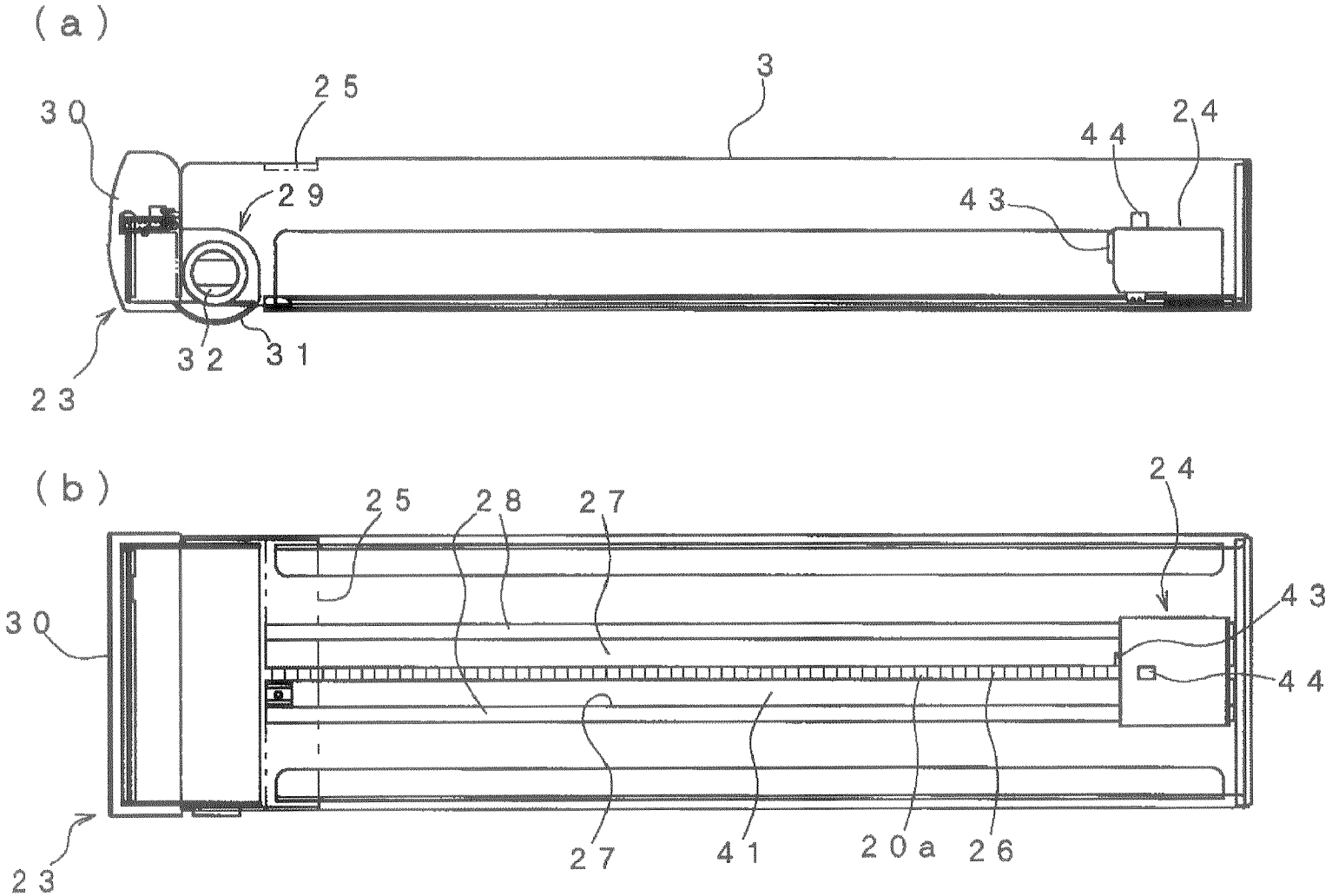
FIG. 6 is a plan view thereof.
Figure 7:
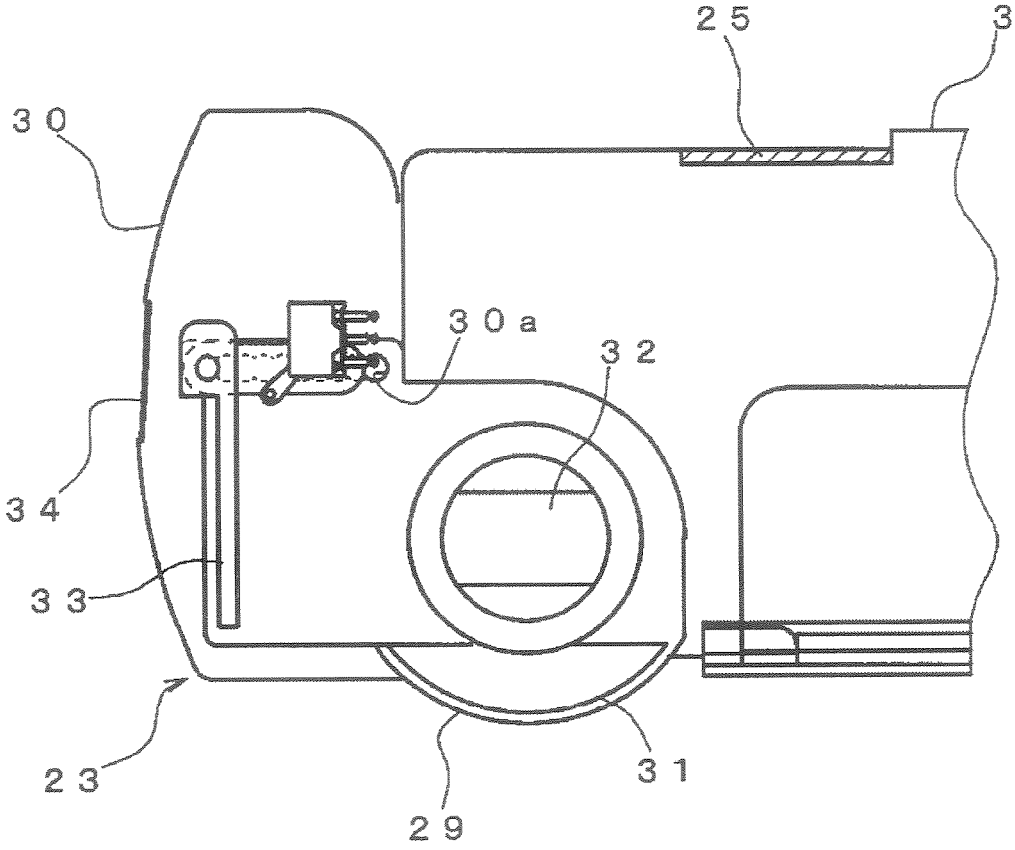
FIG. 7 is an enlarged view of a rotor part of FIG. 6A.
Figure 8:
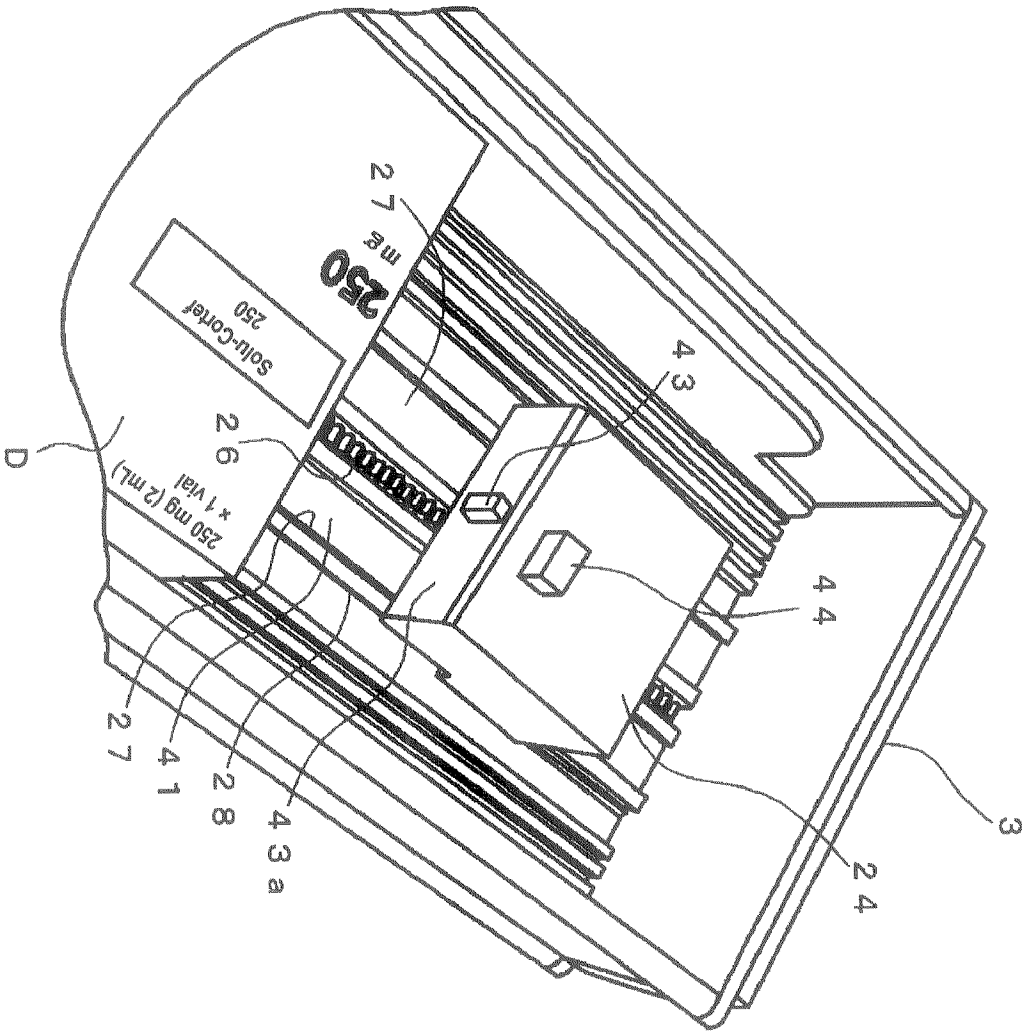
FIG. 8 is a perspective view showing the back end part of the cassette of FIG. 6.
Figure 9:
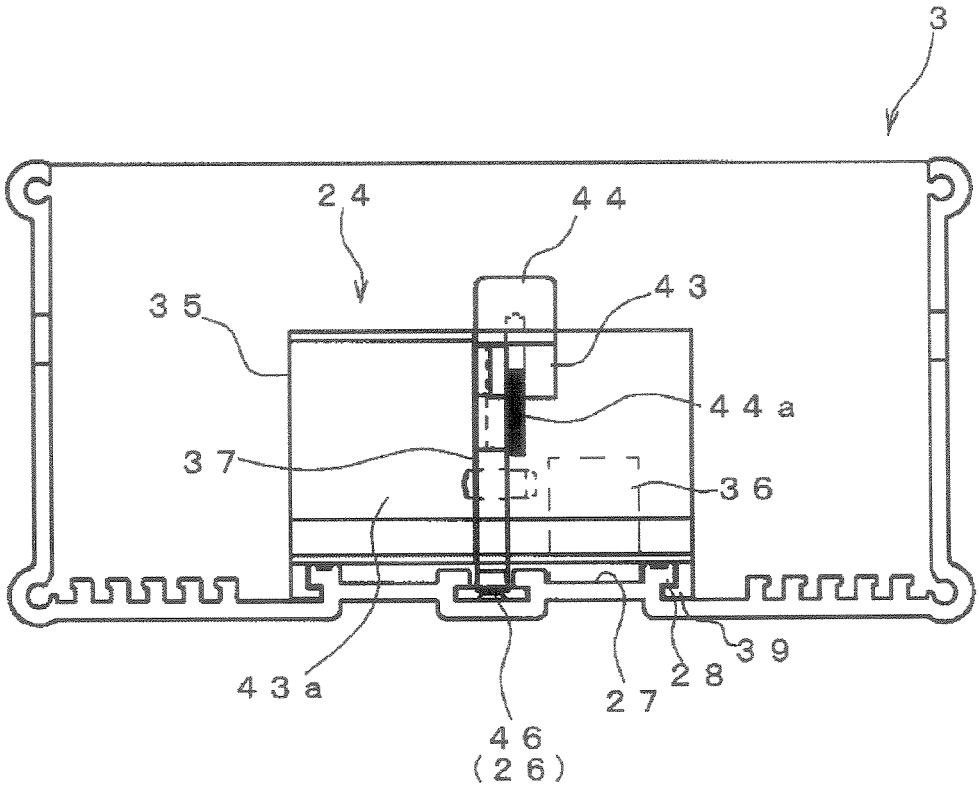
FIG. 9 is an elevation view of the cassette of FIG. 6.
Figure 10:
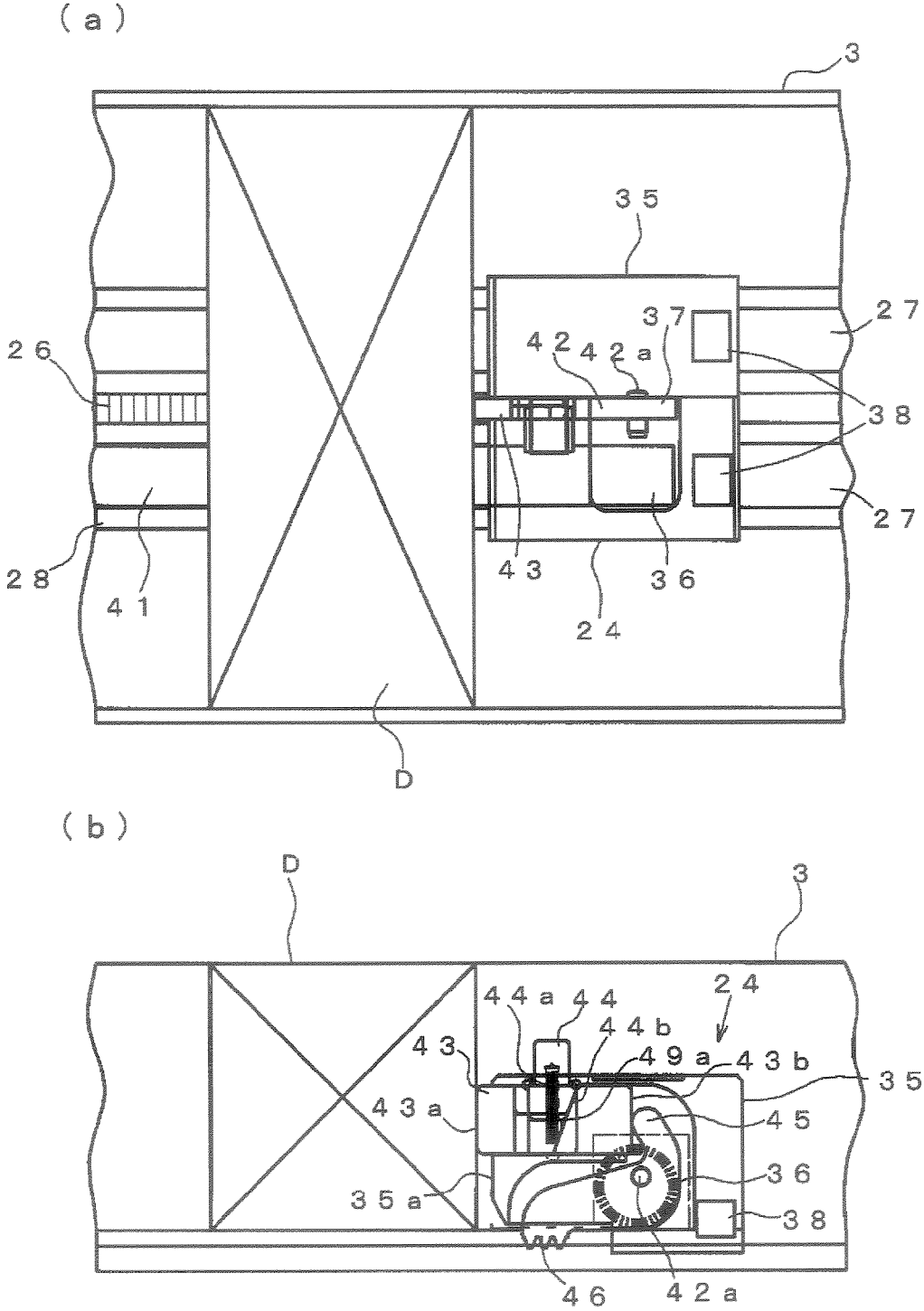
FIG. 10A is a partially enlarged plan view of the cassette of FIG. 6
FIG. 10B is a side view thereof.
Figure 11:
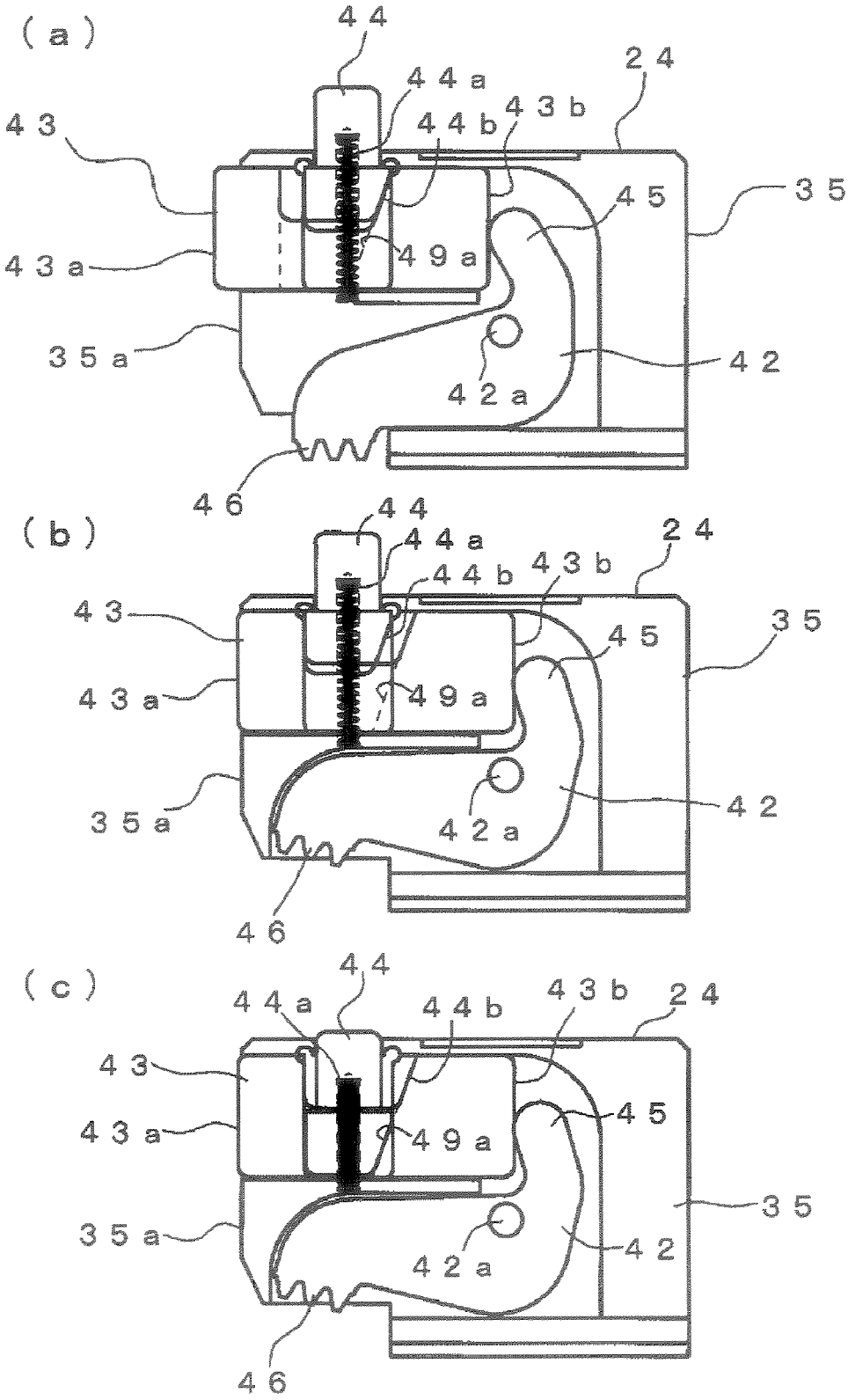
FIG. 11 is an explanatory diagram showing an operating state of a forcing unit shown in FIG. 8.
Figure 12:
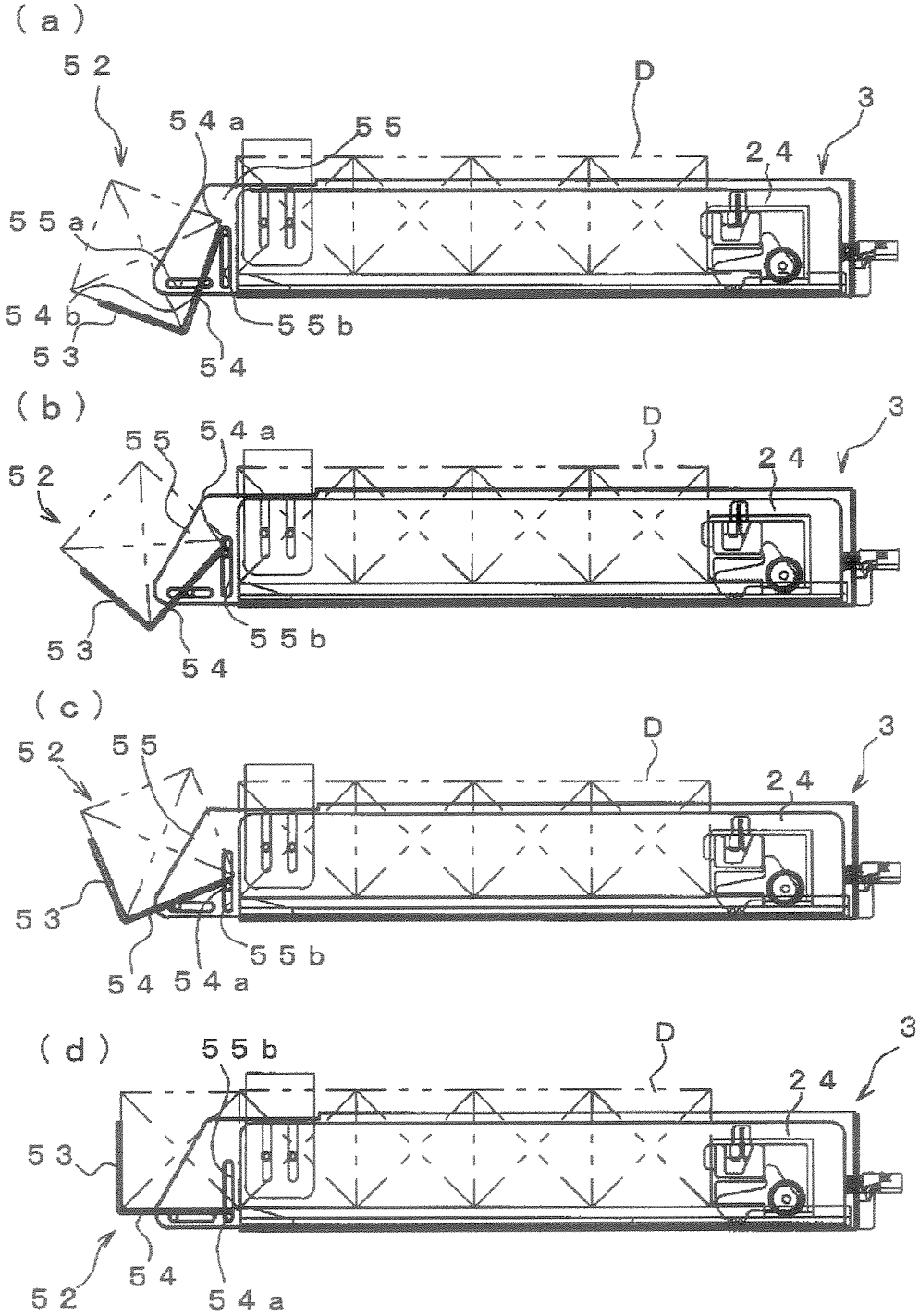
FIG. 12 is a side view showing a cassette according to another embodiment.
Figure 13:
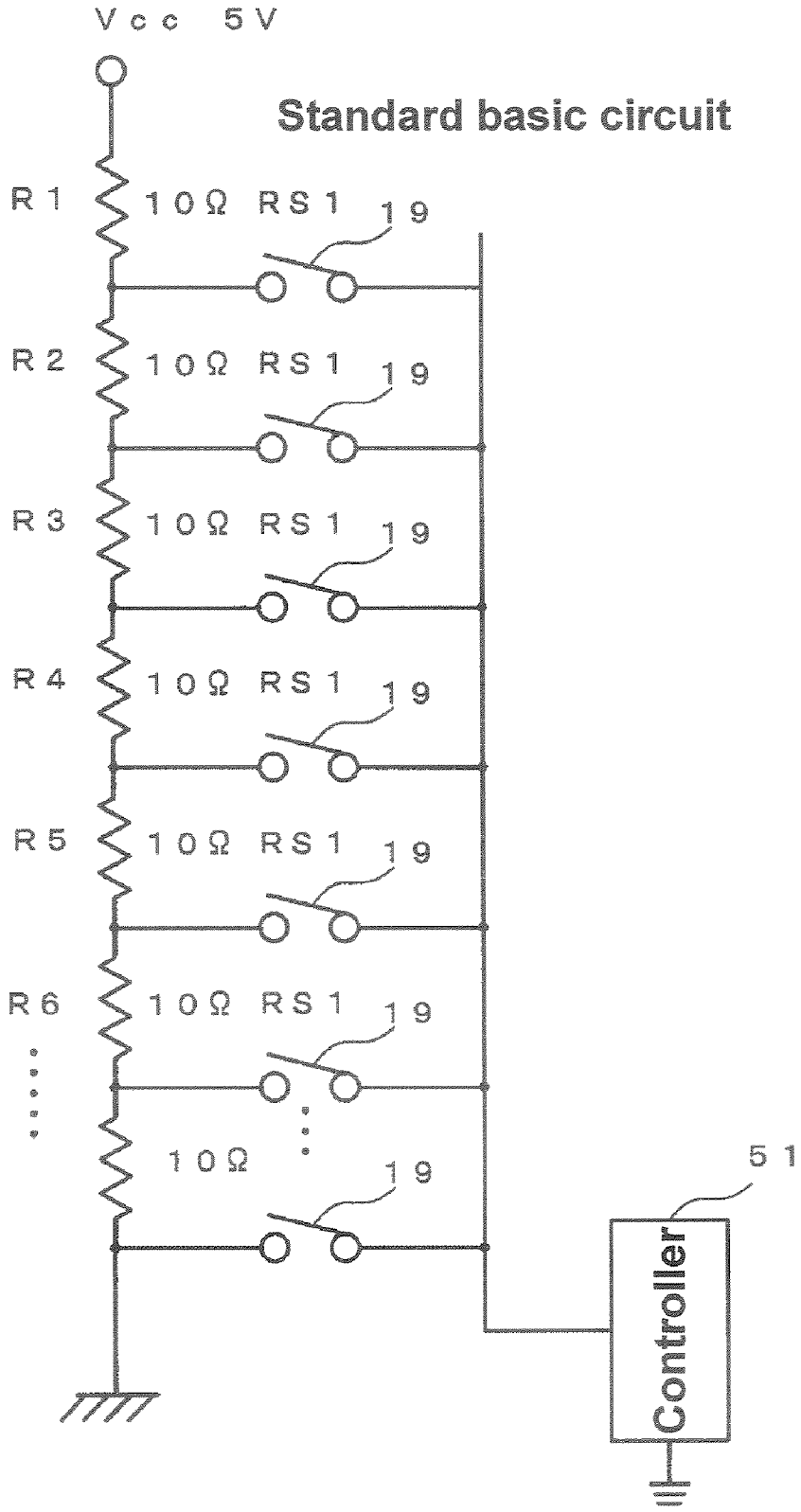
FIG. 13 is a circuit diagram of a basic measuring device.
Figure 14:
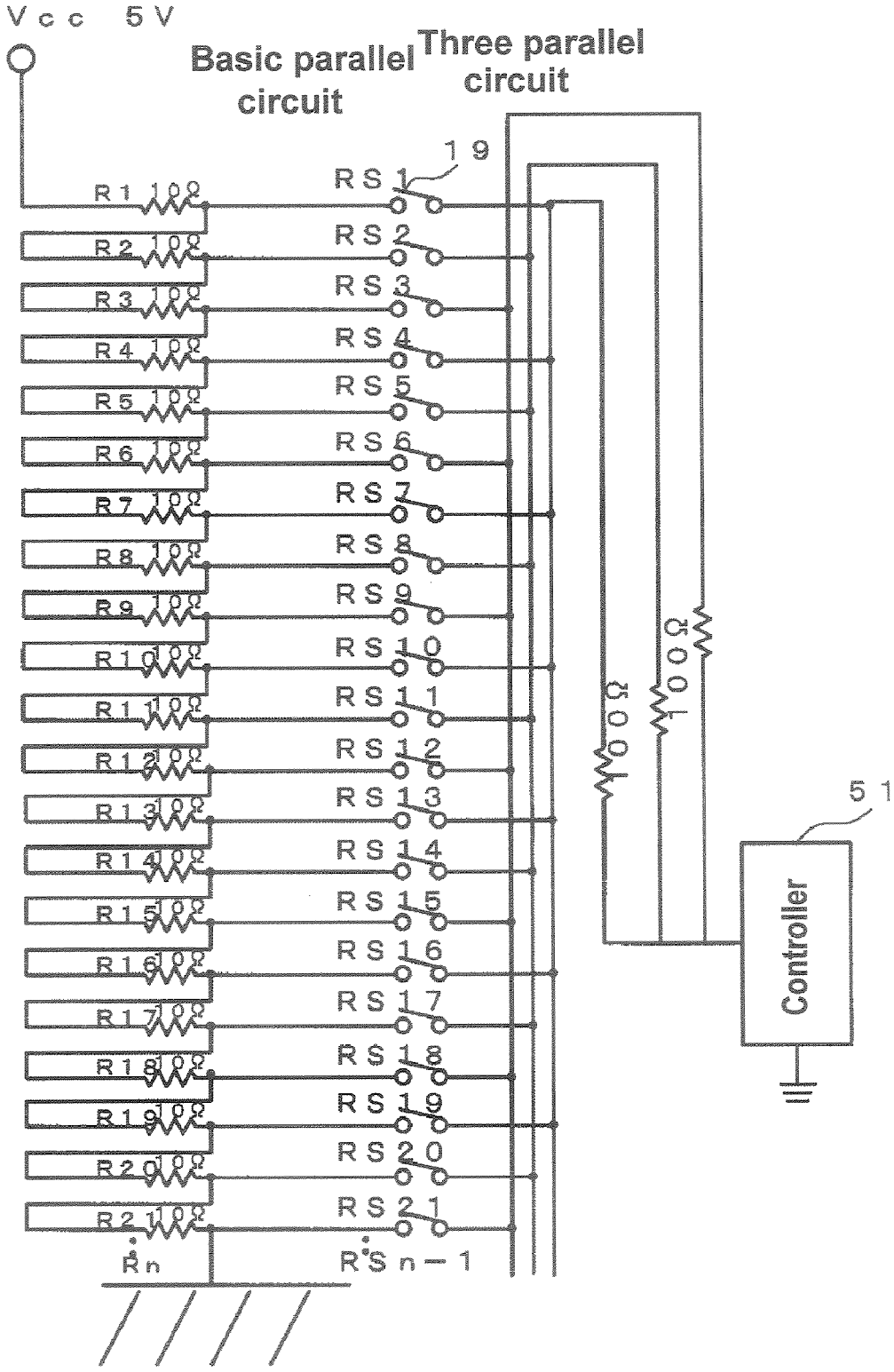
FIG. 14 is a circuit diagram of a three circuit parallel type measuring device.
Figure 15:
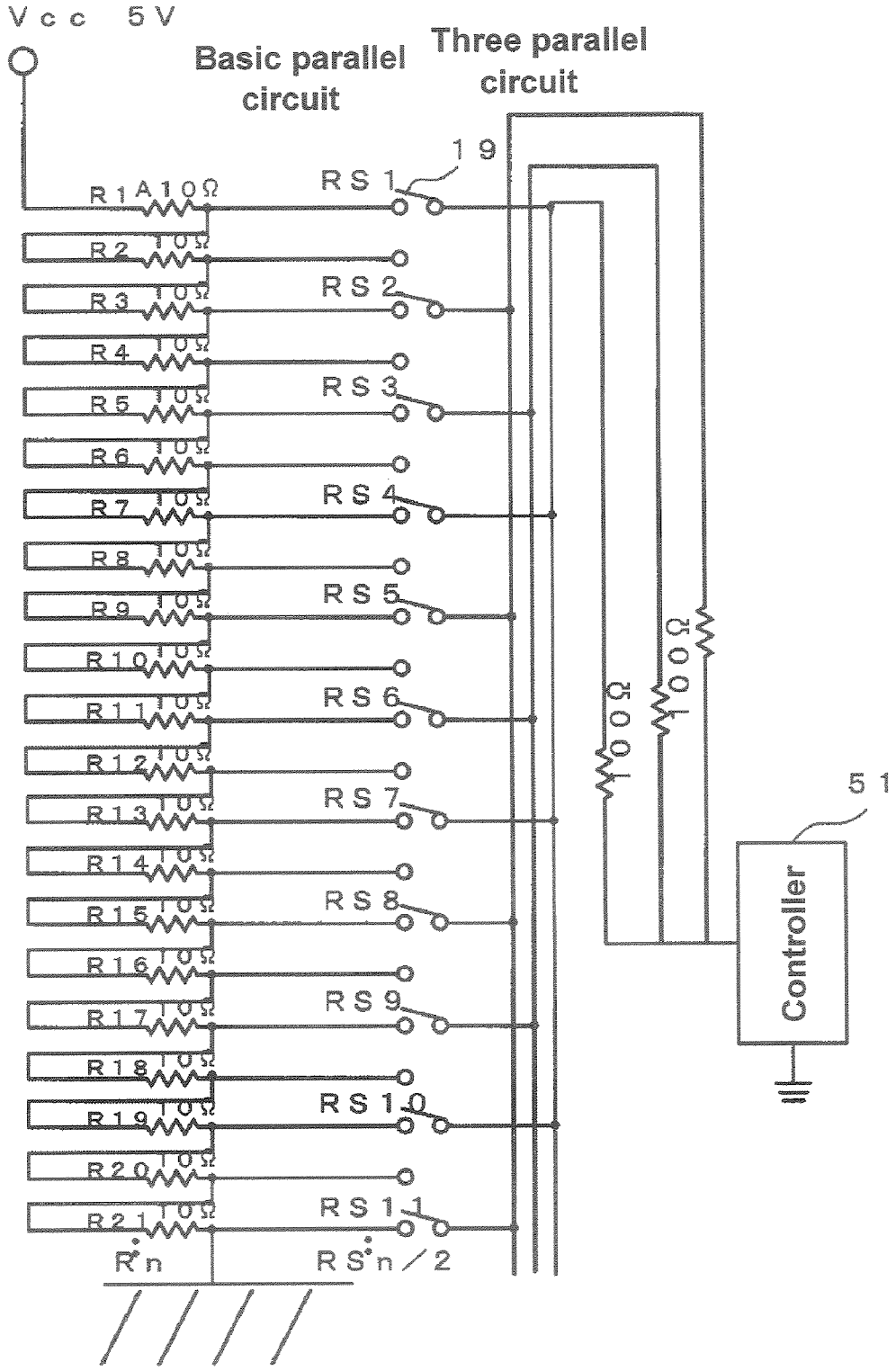
FIG. 15 is a circuit diagram of a modified example of three circuit parallel type measuring device.
Figure 16:
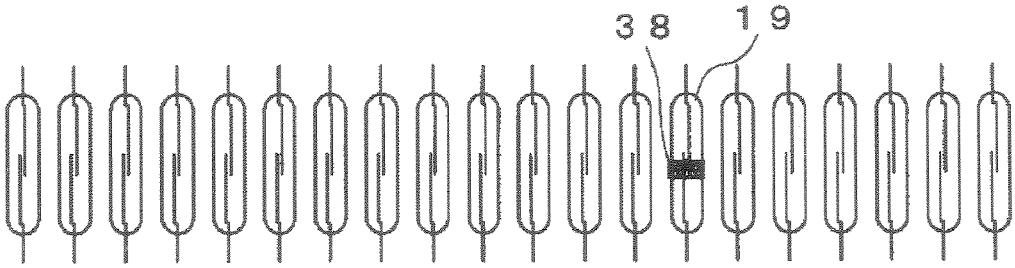
FIG. 16 is a plan view of showing the arrangement of a lead switch.
Figure 17:
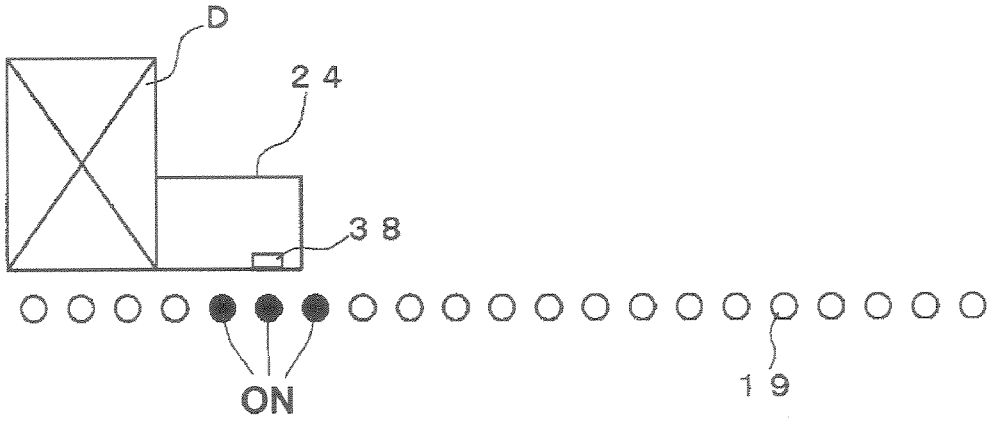
FIG. 17 is a diagram showing principles of measuring a first reference scale of arranged large-diameter drugs.
Figure 18:
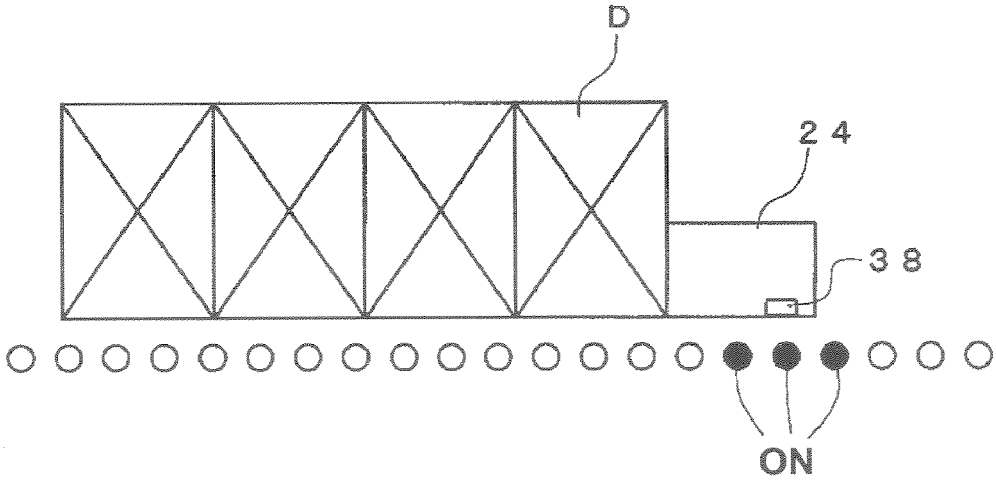
FIG. 18 is a diagram showing principles of measuring a second reference scale of arranged large-diameter drugs.
Figure 19:
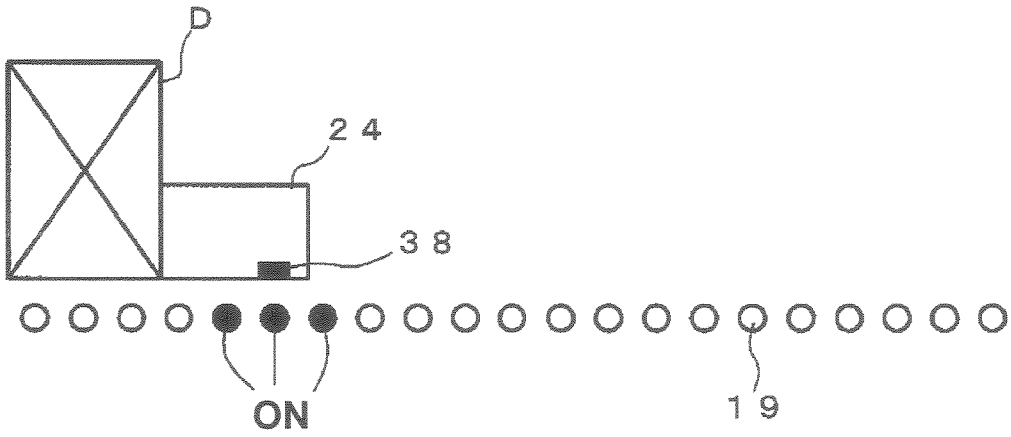
FIG. 19 is a diagram showing principles of measuring a first reference scale of arranged small-diameter drugs.
Figure 20:
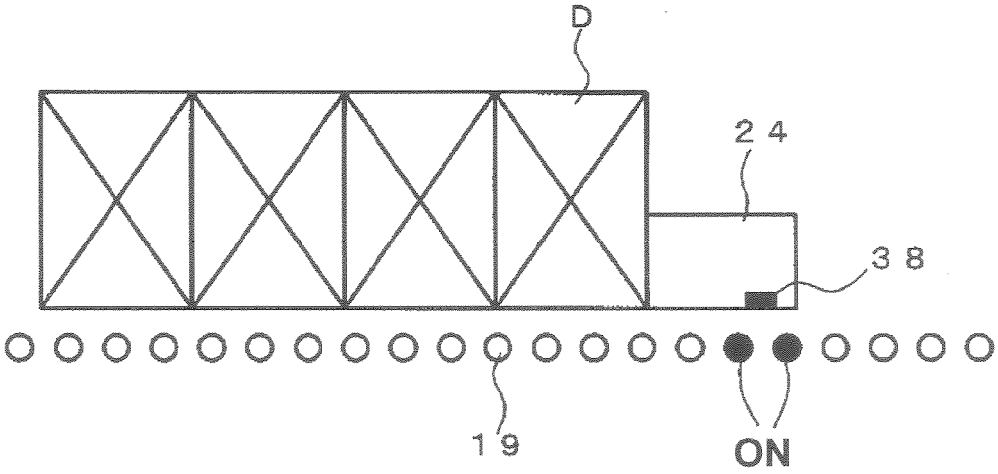
FIG. 20 is a diagram showing principles of measuring a second reference scale of arranged small-diameter drugs.
Figure 21:
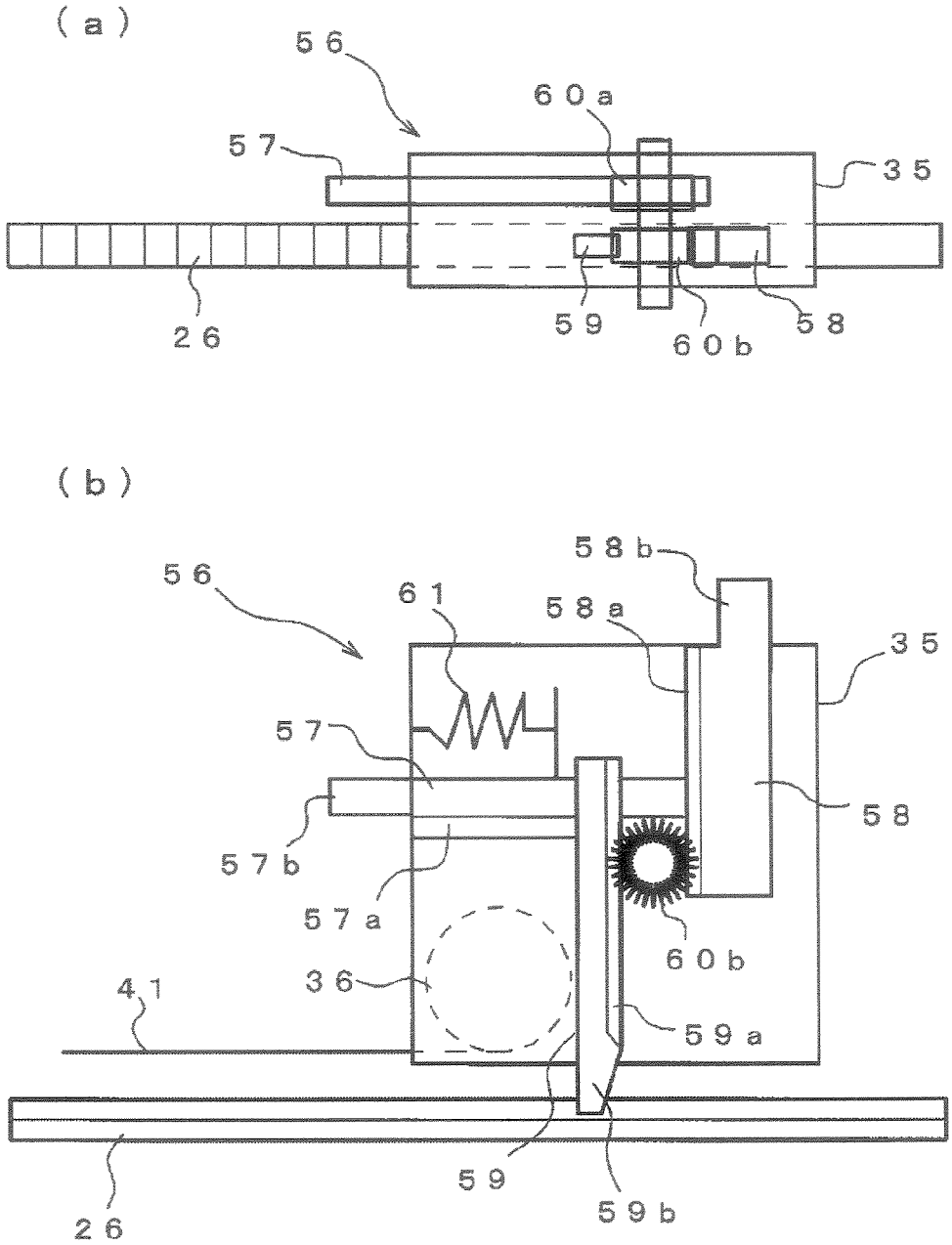
FIG. 21A is a plan view showing a forcing unit according to another embodiment.
FIG. 21B is a side view thereof.

The invention claimed is:

1. A drug dispensing device including cassettes detachably fitted to respective shelves of a storage shelf and storing different types of drugs, each of the cassettes comprising:

a rotor configured to hold a held drug at a closed position at one end side thereof and to rotate the held drug to an open position to thereby permit the held drug to be taken out of the cassette; and biasing means configured to bias a stored drug to a rotor side of the cassette to thereby arrange the stored drug, wherein the biasing means comprises:

a casing having a front contact surface that contacts the stored drug, a constant load spring that is provided in the casing and that includes a spring part having a leading end thereof fixed to the rotor side of the cassette, a locking member that is provided in the casing to be rotatable about a support shaft and that includes a gear part for engaging with and disengaging from a locking rack formed in the cassette, and a pressing member that projects in a pressable manner from the front contact surface of the casing, the pressing member having a first end surface that contacts the stored drug and a second end surface that contacts the locking member, wherein if the first end surface of the pressing member contacts the stored drug, then the pressing member is pressed and the second end surface of the pressing member contacts the locking member to rotate the locking member about the support shaft, whereby the gear part disengages from the locking rack.

2. The drug dispensing device according to claim 1, further including an operation button that projects in a pressable manner from a top surface of the casing and that releases the gear part from the locking rack by rotating the locking member by a pressing operation via the pressing member.

3. The drug dispensing device according to claim 1, wherein the biasing means can change a quantity of constant load springs to be provided in accordance with a difference in a spring force.

4. The drug dispensing device according to claim 1, wherein the rotor includes a circular arc part configured to prevent a movement of the stored drug in a longitudinal direction during a rotation of the rotor.

5. The drug dispensing device according to claim 1, wherein the rotor is formed of a front panel and a bottom plate in a substantially L shape, the bottom plate having a first guide part formed at one end part thereof and having a second guide part formed at a middle part thereof, and wherein the cassette includes a support plate including a first guide receiving part that reciprocatably guides the first guide part of the rotor in a direction orthogonal to a longitudinal direction of the cassette, and a second guide receiving part that reciprocatably guides the second guide part in the longitudinal direction of the cassette.

6. The drug dispensing device according to claim 1, wherein the support shaft extends in a direction transverse to a direction in which the pressing member is pressed.

7. The drug dispensing device according to claim 1, wherein each shelf of the storage shelf includes a lock member that engages with a lock receiving part of the cassette to thereby prevent detachment, wherein a driving force of a motor is transmitted to the rotor via a gear, wherein the gear includes a lock release part that drives the lock member to drop the lock member from the lock receiving part of the cassette.

8. The drug dispensing device according to claim 7, wherein each shelf of the storage shelf includes a key hole through which a key is inserted to thereby drive the lock member, whereby the lock member can be dropped from the lock receiving part of the cassette.

9. The drug dispensing device according to claim 1, wherein the first end surface directly faces the stored drug.

* * * * *